United States Patent [19]

Kankaanpää

[11] 4,113,556

[45] Sep. 12, 1978

[54] PAPER MACHINE WITH TWIN-WIRE FORMER

[75] Inventor: Matti Kankaanpää, Espoo, Finland

[73] Assignee: Valmet Oy, Japan

[21] Appl. No.: 787,321

[22] Filed: Apr. 14, 1977

[30] Foreign Application Priority Data

Apr. 14, 1976 [FI] Finland ..... 761030

[51] Int. Cl.[2] ..... D21F 1/00; D21F 9/00

[52] U.S. Cl. ..... 162/272; 162/301; 162/306; 162/307

[58] Field of Search ..... 162/301, 203, 272, 314, 162/306, 307, 358

[56] References Cited

U.S. PATENT DOCUMENTS

| | | | |
|---|---|---|---|
| 2,730,933 | 1/1956 | Reynolds | 162/307 X |
| 2,843,025 | 7/1958 | Holden | 162/307 |
| 3,311,533 | 3/1967 | De Montigny et al. | 162/203 |
| 3,595,745 | 7/1971 | Cronin | 162/358 X |
| 3,726,758 | 4/1973 | Parker et al. | 162/301 X |
| 3,846,232 | 11/1974 | Kankaanpää | 162/301 |
| 3,996,098 | 12/1976 | Kankaanpää | 162/301 X |
| 3,997,390 | 12/1976 | Kankaanpää | 162/203 X |

FOREIGN PATENT DOCUMENTS 45,583 4/1972 Finland.

*Primary Examiner*—Richard V. Fisher

*Attorney, Agent, or Firm*—Steinberg & Blake

[57] ABSTRACT

A paper machine has a pair of endless wire loops respectively having elongated portions which travel together upwardly along a common path where the wire loops form a twin-wire former. This common path has a lower receiving end for receiving pulp stock from which a web is to be formed and an upper discharge end from which a web issues from the twin-wire former while being transported by one of the endless wire loops beyond the discharging end of the common path. A lower forming roll around which the endless wire loops are lapped determines the lower receiving end of the common path as well as an initial portion of the common path along which the wire loops travel together. An upper forming roll is also lapped by the endless wire loop and determines the discharge end of the common path as well as a final portion thereof. The lower and upper forming rolls cooperate with the endless wire loops to provide at the lower and upper forming rolls dewatering which at least in part occurs in opposite directions at the lower and upper forming rolls, respectively. At least the lower forming roll has a solid shell through which fluid cannot penetrate with the lower forming roll cooperating with the endless wire loops to provide at the lower forming roll a dewatering which takes place at least to a substantial extent in a direction outwardly away from the lower forming roll.

20 Claims, 10 Drawing Figures

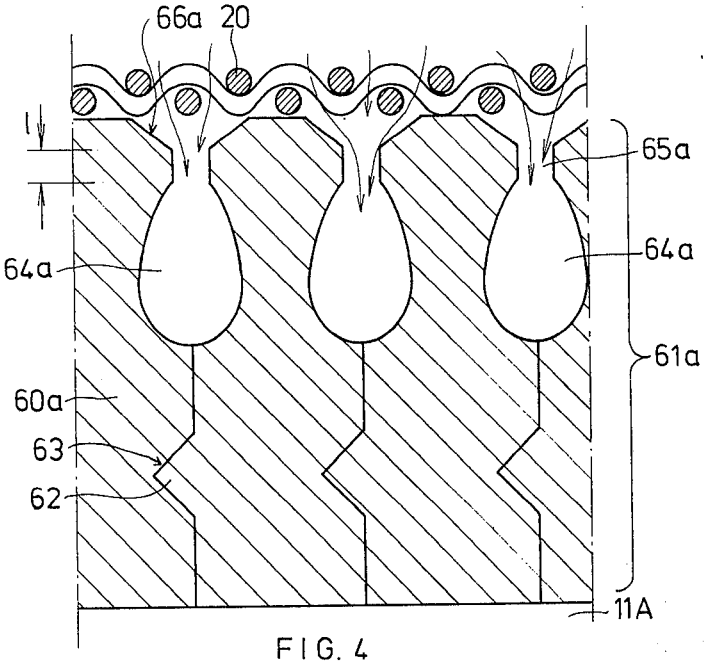
FIG. 4
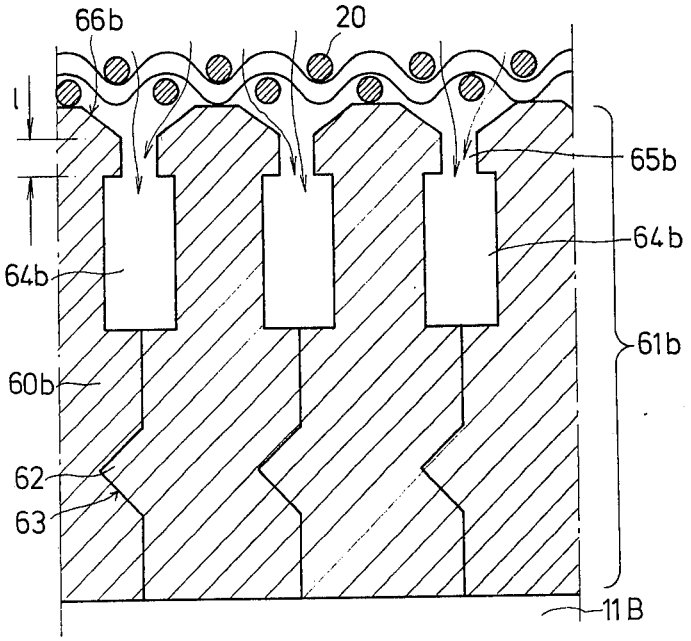
FIG. 5
FIG. 7
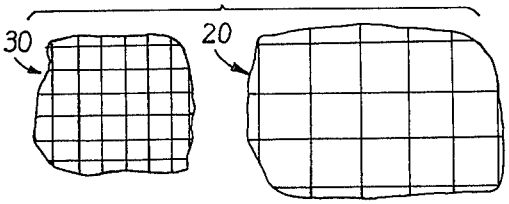
FIG. 6
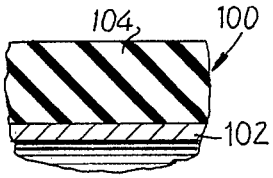

PAPER MACHINE WITH TWIN-WIRE FORMER

BACKGROUND OF THE INVENTION

The present invention relates to paper machines.

In particular, the present invention relates to paper machines having twin-wire formers.

Thus, the present invention relates to a paper machine having a twin-wire former which is provided by way of a pair of endless wire loops which travel upwardly along a common path having a lower receiving end to receive pulp stock from which a web is to be formed and an upper discharge end from which a web issues while being transported beyond the common path by one of the wire loops. Lower and upper forming rolls cooperate with the endless wire loops respectively at the lower and upper end regions of their common path, and in advance of the lower forming roll the paper machine includes a breast roll as well as a headbox which supplies pulp stock to either one or both of the endless wire loops or into a throat defined therebetween at the receiving end of the common path.

Twin-wire formers are utilized in paper machines where the web forming and dewatering of the web while it is being formed takes place primarily or at least to a great extent between two wires. Efforts are always made to provide symmetrical dewatering by way of a twin-wire former, such symmetrical dewatering implying that the dewatering takes place in equal amounts through both of the wires. This result is achieved with known constructions by providing for simultaneous dewatering in opposite directions through both of the wires. Symmetry of the dewatering action is in itself no particular objective but it is worthwhile to achieve because of the fact that it has a great influence on the uniformity of the distribution of the material which forms the paper. Thus, for example, this factor will determine the uniformity of the distribution of fine fibers included in the fiber composition of the paper as well as the distribution of materials such as fillers which are distributed through the thickness of the paper.

Known twin-wire formers generally fall into two main categories. One category has the common run of the wires nearly straight or only slightly curved at the location where the major part of the dewatering occurs. This latter slight curvature may have a radius on the order of, for example, 3,000 mm or more. The joint or common path of travel of the wires is determined, for example, by a guiding action provided by way of at least one stationary shoe and/or several rotating guide rolls. This particular category also includes those known twin-wire formers where both wires have a substantially vertical orientation, so that they define between themselves a formation region which is of a wedge-shaped configuration.

The other main category of twin-wire former which is known in the art is a type of twin-wire former where dewatering of the web, while it is formed, takes place at a so-called forming roll an angular portion or sector of which is lapped by both wires. Such a forming roll will have a diameter on the order of approximately, for example, 1,000–2,000 mm, with the radius of curvature thereof correspondingly being on the order of 500–1,000 mm. The angular region of such a forming roll over which dewatering takes place is on the order of, for example, 90°–120°. These dimensions and ranges are understood as examples only, intended to illustrate the differences existing between the different categories. Such dimensions may depend, for example, on the breadth of the machine, and these dimensions are not intended to restrict the scope of the present invention in any way. The starting point of the present invention resides precisely in twin-wire formers of the above categories.

It is conventional to provide in twin-wire formers a forming roll which usually is a suction roll or another type of roll with a very open construction. However, suction rolls are exceedingly expensive components. The cost thereof increases sharply with an increase in diameter. Such suction rolls may be made of special alloys so that, even though they are perforated, nevertheless they will still have the required strength for a paper machine of great breadth and so that they will behave durably with respect to adverse corrosion conditions. Moreover, the drilling of holes through the shells of suction rolls involves high manufacturing costs.

Furthermore, the use of a suction roll requires also a connection to a vacuum system. In order to generate the vacuum a suction pump is required, so that in this latter connection also there are high energy costs.

SUMMARY OF THE INVENTION

It is accordingly a primary object of the present invention to provide further developments of twin-wire formers of the above general types, particularly with a view to reducing the costs of such twin-wire formers and especially in twin-wire formers where the radius of curvature of the forming zone is on the order of 500–1,000 mm. at the initial part of the common path of the twin wires.

It is a further object of the present invention to maintain a substantially symmetrical dewatering with the advantages which result therefrom.

It is also an object of the present invention to provide a twin-wire former where in the dewatering there is no provision of maximum efficiency at the expense of paper quality.

With the construction of the invention in order to achieve a control providing alternating substantially one-sided and symmetrical dewatering while formation of the web takes place in the direction of travel thereof, at least the first forming roll at the initial part of the common path of the twin wires has a solid or closed shell which cannot be penetrated by fluid, with dewatering taking place primarily in a direction away from such a forming roll, the latter being tangentially contacted by the twin wires.

For such a forming roll means which has a closed shell it is possible to utilize, in accordance with the invention, relatively inexpensive raw material, this material being far less expensive than that which is essential for a suction shell roll. This feature is one of the primary advantages of the invention. The solid shell may be smooth or its surface may be recessed as by having therein grooves or blind holes which are drilled only partially through the thickness of the solid shell from the outer surface thereof. Thus, these holes do not pierce through the shell.

A particularly advantageous solution to the problem is to utilize for the solid shell a rubber-clad roll. The advantages of a rubber-clad roll include the fact that it has a surface which is easy to treat as, for example, by providing the surface with grooves, recesses, or holes which extend only partly through the thickness thereof. An advantage of a rubber-coated roll is the fact that such a roll adheres effectively to the wire, the efficiency of the contact between the wire and such a rubber-clad roll resulting from the fact that there is high natural friction therebetween with slipping between such a roll and the wire being far less than in the case where a metallic roll is utilized. Moreover, such a rubber-clad roll is not subject to corrosion to the same degree as a metallic roll, even in the case where the latter type of roll is made of a high-quality metal.

According to a further feature of the invention, advantage is taken of the use of a pair of forming rolls, thus offering several different possibilities for control and adjustment of the operation of the former as well as for selection of a design thereof, with a view to the particular type of paper which is to be manufactured in each particular case. Both forming rolls are in the simplest and least-costly embodiment of the invention smooth rolls so that dewatering takes place alternatively in only one direction at any given time, namely away from the surface of the forming roll. When two such forming rolls are utilized one after the other, then the forming wires lap these rolls in such a way that the first roll is lapped, for example, in a clockwise direction and the second roll in a counterclockwise direction, so that with such an arrangement symmetrical dewatering is achieved to provide a sufficiently high-quality end product under certain preconditions. A solution of this type is particularly satisfactory with a machine which operates at low speed and can also be utilized in those situations where an extremely thin paper is manufactured, in which case the quantity of water escaping from the web during the forming thereof is relatively small. When considering all the factors, it is not essential to achieve maximum efficiency of dewatering at the first forming roll.

In those cases where the machine operates at a high speed and when operating with high pulp stock dilutions, the quantity of water emerging from the web in the forming stage is high. Under such conditions it is advantageous if the forming rolls have a recessed surface permitting dewatering in appreciable quantity also to take place in a direction inwardly toward each forming roll which is either drilled with blind holes or which is grooved. In general it is easier and less expensive to manufacture groove rolls than rolls with holes drilled therein. The use of grooves is particularly advantageous if manufactured as disclosed in Finnish Pat. No. 45,583. According to this latter patent a strip of special profile is wound upon the shell of the roll. In addition to the fact that production of a grooved roll in this way is relatively easy, certain advantages may be gained from the particular configuration of the grooves. Thus the grooves may have a configuration which will favorably influence the dewatering when the grooved roll is utilized as at least one of the forming rolls of the twin-wire former. The use of a grooved roll is preferred to a foraminous roll, when taking into consideration the life span of the wire. A suction roll which has several hundred thousand holes piercing through the shell thereof has an extremely large number of sharp edges at its exterior surface, these sharp edges exerting a poweful abrasive action on the wire.

In the case where two forming rolls are utilized, it is advantageous if only the first forming roll is a grooved roll, inasmuch as the quantity of water removed at the initial part of the twin-wire path is greatest. In this case the second roll can be a smooth roll, and such a construction is of course less expensive than in the case where both rolls are grooved. Functionally, a solution of this latter type is also most often satisfactory inasmuch as the greater part of the dewatering takes place in the region of the first roll.

Thus, with the above considerations in mind, it is noted that the present invention provides in its most favorable embodiment a simple former which does not include any expensive suction rolls and which therefore does not require suction pump energy. Moreover, with such a construction the task of keeping the forming rolls clean is easier than would otherwise be the case. Inasmuch as no vacuum piping is required for the suction rolls, the construction is also simplified in connection with wire-changing operations.

Moreover, the structure of the invention insures a symmetrical dewatering so that good printing properties of the paper, uniform structure thereof, etc. are achieved. With respect to the dewatering there is no attempt to achieve a maximum efficiency at the expense of paper quality. Therefore, the main part of the dewatering is not necessarily accomplished, as is conventional, at the first forming roll. In contrast, according to the invention there may be an intentional retarding of the extent of dewatering which takes place at the initial part of the common path of travel of the twin wires.

BRIEF DESCRIPTION OF DRAWINGS

The invention is illustrated by way of example in the accompanying drawings which form part of this application and in which:

FIG. 4 is a fragmentary sectional illustration of the grooved part of a forming roll;

FIG. 5 is a fragmentary sectional illustration of another embodiment of a grooved roll construction;

FIG. 6 is a fragmentary sectional illustration of yet another type of forming roll according to the invention; and FIG. 7 fragmentarily illustrates portions of a pair of wires, for the purpose of illustrating the relationship between the densities of the mesh thereof.

DESCRIPTION OF PREFERRED EMBODIMENTS

Figure 1:
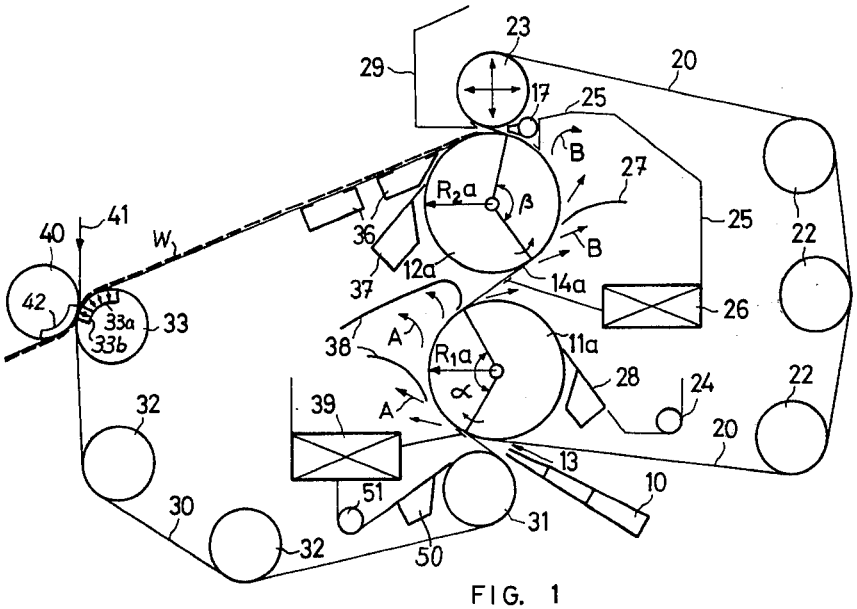
FIG. 1 is a schematic elevation of the machine according to the invention which has two solid shell forming rolls situated one above the other.

The different paper machines which are partially illustrated schematically in the drawings include a pair of endless wire loops 20 and 30. These endless wire loops 20 and 30 have elongated portions which travel together upwardly along a common path so as to provide in this way a twin-wire former. The common path has a lower receiving end for receiving pulp stock from which a web is to be formed and an upper discharge end from which the web issues from the common path of the twin-wire former. In the illustrated embodiments it is the endless wire loop 30 which continues to transport the web beyond the upper discharge end of the common path of the twin-wire former. the wire 30 is guided by guide rolls 32, while the wire 20 is guided by guide rolls 22.

Situated in advance of the lower receiving end of the common path of the twin-wire former is a headbox means 10 which directs pulp stock toward the throat 13 defined between the wires 20 and 30 as they converge toward each other while approaching the lower receiving end of the common path of the twin-wire former. It is, however, also possible to use two headboxes and other similar designs. In this connection reference may be made to U.S. Pat. No. 3,997,390.

One of the important features of the invention resides in providing for at least substantial dewatering in an alternatingly one-sided manner, which is to say the dewatering takes place in one direction at a lower forming roll means and in an opposite direction at an upper forming roll means. Thus, in the embodiment of FIG. 1, there is a lower forming roll means 11*a* in the form of a roll of radius $R_1a$ which has a solid shell which cannot be penetrated by fluid, and it will be seen that this lower forming roll means 11*a* is lapped by both of the wires 20 and 30 and determines the receiving end of the common path of travel thereof as well as the initial portion of the common path of travel of the wires 20 and 30 where they provide the twin-wire former. The twin-wire former of FIG. 1 also includes an upper forming roll means 12*a* of radius $R_2a$ equal to radius $R_1a$ and also having a solid shell which cannot be penetrated by fluid. This upper forming roll means 12*a* determines the discharge end of the common path of travel of the wires as well as the final portion of their common path of travel. As is apparent from FIG. 1, the wires 20 and 30 are curved in a clockwise direction around part of the lower forming roll means 11*a* and in a counterclockwise direction around part of the upper forming roll means 12*a*, with the wires being tangent to the forming roll means 11*a* and 12*a* and having a straight intermediate portion 14*a* extending freely between the lower and upper forming roll means. Thus the common path of travel of the wires has an S-shaped configuration. The common path of travel of the wires 20 and 30 starts at the sector $\alpha$ of the lower forming roll means 11*a* and then continues along the straight draw 14*a*, whereupon there is a final curved portion of the common path extending along the angular sector $\beta$ of the forming roll means 12*a*. Subsequent to the discharge end of the common path the web W continues to be transported by the endless wire loop 30 toward the left, as viewed in FIG. 1. At the lower forming roll means 11*a*, dewatering takes place in the direction indicated by the arrows A away from the solid shell of the forming roll means 11*a*. Similarly, dewatering takes place in the opposite direction at the upper forming roll means 12*a*, as indicated by the arrows B, this direction also being away from the solid shell of the forming roll means 12*a*. In this way the alternatively one-sided dewatering is achieved.

As is apparent from FIG. 1, the upper forming roll means 12*a* is situated above the lower forming roll means 11*a*, and both of these forming roll means have equal diameters. In the event that the angular sectors $\alpha$ and $\beta$ lapped by the wires at the lower and upper forming roll means of FIG. 1 are equal to each other, then, the operation will be such, in accordance with general known draining laws, that the dewatering from the pulp stock between the wires will take place primarily at the lower forming roll means 11*a* through the wire 30. The quantity of water escaping through the wire 20 will be considerably less, and the desired symmetry in the dewatering action will not be achieved. While maintaining the construction as shown in FIG. 1 with respect to the forming roll means, it is possible, with a view to retarding the dewatering which takes place at the lower forming roll means, in order to reduce the quantity of dewatering at this location, to utilize, for example, a wire 30 the fabric of which is denser than that of the wire 20. Thus, FIG. 7 illustrates such a construction where it will be seen that the wire 30 has a substantially denser mesh than the wire 20, so that the spaces between the strands which form the wire 20 are greater than those between the strands which form the wire 30. Thus, the water cannot pass as freely through the mesh of the wire 30 as through the mesh of the wire 20, and in this way the difference between the meshes of the wires will contribute to the symmetrical dewatering.

It is possible to control the dewatering zone at the lower roll means 11*a* by changing the position of the breast roll 31. In order to insure, however, that there is a sufficient overall dewatering action, the dewatering sector of the upper forming roll means 12*a*, namely the sector $\beta$, may be increased by increasing the angle through which the upper forming roll means 12*a* is lapped by the wires. For this purpose a guide roll 23 around which the wire 20 extends immediately subsequent to the discharge end of the common path of the wires is adjustable so as to adjust the angle $\beta$. Thus, the vertical and horizontal double-headed arrows shown at the roll 23 in FIG. 1 designate an adjusting means operatively connected with the roll 23 for adjusting the latter in opposite directions either vertically or horizontally or both, so as to bring about in this way a control of the angle through which the upper forming roll means 12*a* is lapped by the pair of wires.

Figure 1A:
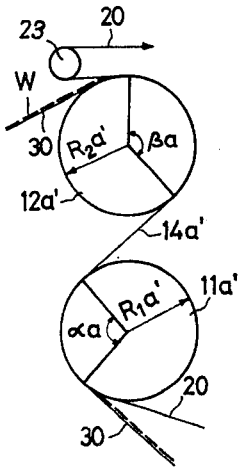
FIGS. 1*a*, 1*b*, and 1*c* respectively illustrate schematically different possibilities with respect to variations of the forming rolls and of the dewatering zones thereof, according to the invention.
Figure 1B:
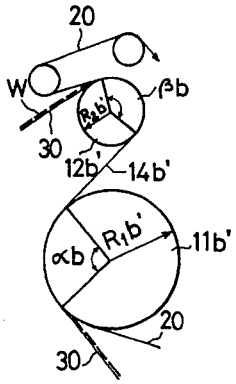
Figure 1C:
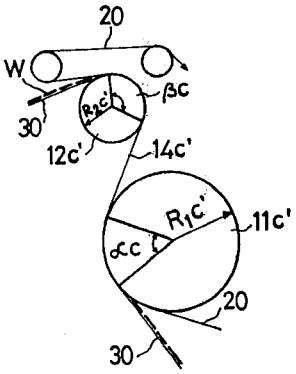

The particular geometry with respect to the situation of the rolls and the path of the wires as shown in FIG. 1 is not always feasible. This is particularly true with respect to the diameter and position of the upper forming roll means 12*a*. In this latter connection, several alternatives may be contemplated, in order to affect the range of the dewatering zone and the efficiency of the dewatering. Examples of such variations are schematically illustrated in FIGS. 1*a*, 1*b*, and 1*c*, As is apparent from FIGS. 1*b* and 1*c*, in these embodiments the lower forming roll means 11*b*′ and 11*c*′ respectively have radii R1*b*′ and R1*c*′ which are substantially greater than the corresponding radii R2*b*′ and R2*c*′ of the upper forming roll means 12*b*′ and 12*c*′ of FIGS. 1*b* and 1*c*, respectively, with open draws 14*b*′ and 14*c*′ being provided as illustrated. As a result of this feature, the pressure exerted by the tension of the wires 20 and 30 on the web W which is situated at or being formed between the wires at the upper forming roll means is substantially greater than the pressure exerted by the tension on the web forming at the lower forming roll means of FIGS. 1*b* and 1*c*. It will be seen that the latter lower forming roll means of FIGS. 1*b* and 1*c* respectively have diameters which are twice the diameters of the corresponding upper forming roll means. In addition, the centrifugal force at the upper roll means of FIGS. 1*b* and 1*c* is greater than at the lower roll means of this embodiment. In the case where, as shown in FIG. 1*c*, the upper roll means 12*c*′ is displaced with respect to the lower roll means so as to be closer to the press section of the paper machine, then the angle $\alpha c$ along which the lower roll means 11*c*′ is lapped by the wires 20 and 30 is reduced.

In the case of the embodiment of FIG. 1*a*, it will be seen that while the lower forming roll means 11*a'* and the upper forming roll means 12*a'* have substantially equal radii R1*a'* and R2*a'*, respectively, with an open draw 14*a'* nevertheless the angle $\beta a$ through which the upper roll means 12*a'* is lapped by the wires is greater than the angle $\alpha a$ through which the lower roll means 11*a'* is lapped by the wires. This relationship is brought about by adjusting the roll 23 so that it is shifted toward the left as compared to the position thereof shown in FIG. 1.

With the embodiments of FIGS. 1*a*, 1*b* and 1*c*, there are certain relationships. Thus in FIG. 1*a* the angle $\alpha a$ is substantially smaller than the angle $\beta a$, while the radii of the forming roll means 11*a'* and 12*a'* are substantially equal to each other. In FIG. 1*b* the angle $\alpha b$ is substantially smaller than the angle $\beta b$. In FIG. 1*c* the angle $\alpha c$ is much smaller than the angle $\beta c$. It is thus possible within a considerable range to influence the dewatering and symmetry thereof. The control of the formation of the web may also be influenced by providing in advance of the initial twin-wire curved path $\alpha$ a single-wire construction with this single-wire portion cooperating with a forming board or other equivalent structure which supports the single-wire part at the location where the jet of pulp stock from the headbox is received by the single-wire part. Thus on this initial single-wire run those means may be applied which the practicing paper maker is accustomed to utilize on single-wire paper machines.

If, as illustrated in FIG. 1, the lower and upper forming roll means 11*a* and 12*a* have smooth exterior surfaces, then it is an easy matter to keep these rolls clean. For this purpose the forming roll means 11*a* is engaged by a doctor blade 28, with a drain pipe 24 being provided for the doctor 28. In a similar manner, a doctor 37 cooperates with the forming roll means 12*a*. Also a doctor 50 is shown cooperating with the breast roll 31. A drain 51 is provided for the doctor 50.

As has been indicated above, the endless wire loop 20 is guided immediately subsequent to the discharge end of the common path of travel of the wires by a guide roll 23. This guide roll 23 is thus situated adjacent to the upper forming roll means 12*a*. The position of the guide roll 23 is of course adjustable in all directions as indicated above. By this adjustment of the guide roll 23 it is possible to influence the detachment of the web W from the wire 20 as well as the magnitude of the angle $\beta$ which is lapped by the wires, as pointed out above.

Situated adjacent to the guide roll 23, beneath the latter, a blower means 17 is provided. This blower means 17 is in the form of a pipe communicating with the source of compressed air and having an outlet nozzle directed toward the wire 20, so that in this way a jet of air will pass through the mesh of the wire 20 at the region where this wire travels through the illustrated relatively short distance from the upper forming roll means 12*a* to the guide roll 23. This jet provided in this way through the wire 20 will insure that the web W becomes reliably detached from the wire 20 at the end of the common path of travel of the twin wires with the web continuing to be transported by the wire 30 beyond the discharge end of the common path of the wires. In connection with the guide roll 23, FIG. 1 schematically illustrates a water splash guard 29.

Within the endless wire loop 30, there is a water-draining saveall 39 which houses within itself the parts of the wires 20 and 30 which lap the lower forming roll means 11*a*. At this location there are baffles 38 to guide the water which emerges from the web. In a similar manner, within the saveall 39 there are one or more suction boxes 36, although such suction boxes are not always required, particularly in the case where relatively thin paper is manufactured.

In a corresponding manner there is a saveall 25 within the endless wire loop 20. This saveall 25 has a drain pipe 26. Also, within the saveall 25 there is a guard baffle 27 adjacent to the sector $\beta$ of the upper forming roll means 12*a* which is lapped by the wires.

As has been indicated above, the web that becomes felted at the twin-wire run is conducted beyond the twin-wire run by the wire 30, as indicated in FIG. 1. Within the endless wire loop 30 there is a return roll means 33 as well as additional guide rolls 32. The web W is detached from the endless wire loop 30 at the region of the return roll means 33 by way of a pick-up roll 40 which in itself is known, this pick-up roll 40 being lapped by a pick-up felt 41 which forms an endless transfer felt for transferring the web W away from the wire 30 and continuing to transport the web W to the press section. The roll 40 has a suction zone 42 assuring transfer of the web from the wire 30 to the transfer felt 41. Thus, the transfer of the web W from the wire 30 takes place at a location between the return roll 33 and the next-following guide roll 32. Instead of utilizing a pick-up roll 40 it is possible to utilize a pick-up box.

With respect to the machine structure illustrated in FIG. 1, when the machine operates at very high speeds, it is possible to construct the lower forming roll means 11*a* so that it has a recessed surface, although the shell is still solid. Advantageous embodiments of such a recessed surface in the form of a grooved roll are illustrated in FIGS. 4 and 5, described below. Instead of a grooved roll it is also possible for the recessed surface to be formed by blind drilled holes.

Figure 2:
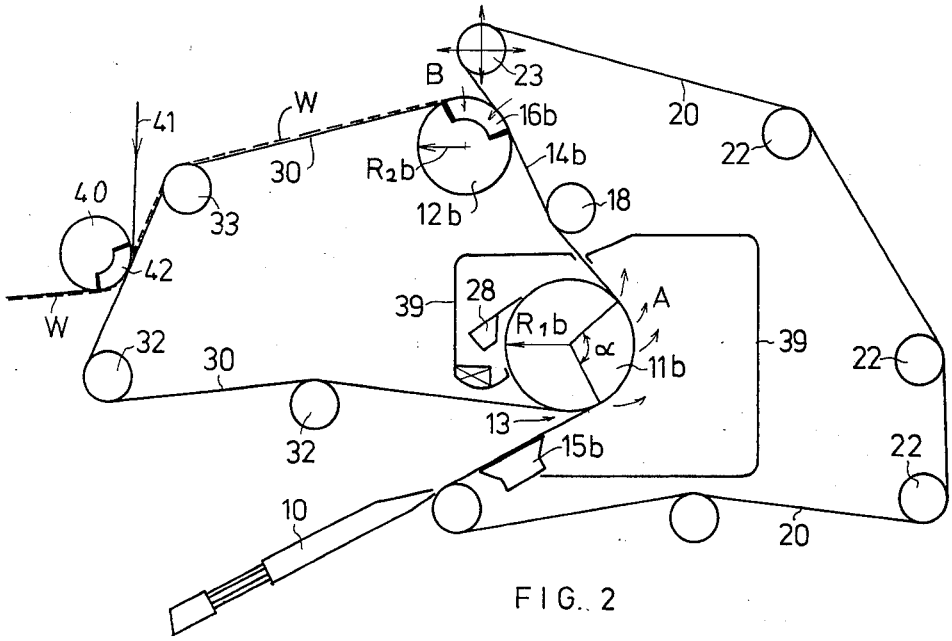
FIG. 2 is a schematic elevation of an embodiment of the invention where two forming rolls are situated within the same wire loop.

As is indicated in FIG. 2, the twin-wire former illustrated therein includes the lower forming roll means 11*b* and the upper forming roll means 12*b*. In this embodiment however, both of the forming roll means are situated within the endless wire loop 30. According to FIG. 2, the upper forming roll means 12*b* is a suction roll, having a suction zone 16*b*. Thus at this upper roll means 12*b* the dewatering at the region of the suction zone 16*b* is for the most part in the direction of the arrows B, inwardly toward the roll 12*b*. Thus in this case the dewatering takes place inwardly toward the suction chamber through perforations in the shell of the roll 12*b*. Thus in this case the dewatering at the upper forming roll means 12*b* is in one direction only, this direction of course being opposite to the direction of dewatering taking place at the solid-shell lower forming roll means 11*b*. Dewatering at the latter roll means is indicated by the arrows A in FIG. 2.

In the embodiment of FIG. 2, the intermediate portion 14*b* of the common path of travel of the wires cooperates with a wire guide roll 18 or other equivalent construction such as a shoe-like guide member. Thus the guide means 18 is situated between and spaced from the forming roll means 11*b* and 12*b* along the common path of travel of the wires in the embodiment of FIG. 2. This guide means 18 is situated within the endless wire loop 20 and provides where the wires lap the guide means 18 a curvature for the wires which is opposite to the curvature thereof at the lower and upper forming roll means 11*b* and 12*b*. Of course, the guide means 18 contributes to the compression of the web between the wires 20 and 30. Thus, the roll 18 may, in a way, be considered as the equivalent of the roll 12*a* of FIG. 1.

It will be noted from FIG. 2 that the upper forming roll means 12*b*, which in this embodiment is a suction roll, has a radius R2*b* which is considerably smaller than the radius R1*b* of the lower forming roll means 11*b*. This lower forming roll means 11*b* may have either a smooth surface or may have a suitably grooved surface. In the illustrated example the roll 11*b* has a smooth surface and is cleaned by way of the doctor 28.

In addition, according to the embodiment of FIG. 2, in advance of the receiving end of the common path of the wires where they lap the lower forming roll means 11*b*, the endless wire loop 20 forms a single-wire portion receiving the pulp stock from the headbox means 10 and delivering the pulp stock to the throat 13. A forming board 15*b* supports this single-wire portion of the machine. Thus in this way a certain amount of initial dewatering and web formation may take place on the single-wire portion prior to travel of the forming web through the twin-wire run.

The return roll means 33, such as the return roll means 33 of FIG. 1, may have either a solid shell or a foraminous shell. In the event that a foraminous shell is utilized, it is advantageous to provide the return roll means 33 with a suction zone 33*a*, so that in this way it is possible to continue the dewatering of the web in the event that the dry matter content thereof is insufficient at the stage where the web W reaches the return roll means 33. The suction zone 33*a* may be followed by a pressure zone 33*b* communicating with a source of compressed air and through which air may be directed outwardly through the foraminous shell of the return roll means 33. Thus, this blowing compartment 33*b* of the return roll means 33 may be utilized to facilitate the detachment of the web W from the wire 30.

It is furthermore apparent that a considerable, substantial change of direction of the wire 30 is brought about by way of the return roll means 33. As a result the effect of centrifugal force generated at this location will also facilitate the detachment of the web W from the wire 30. In this event the pick-up roll 40 or the equivalent suction box may be situated closely adjacent to the return roll means 33. It is then possible to employ the suction and/or blowing effect and the suction and guiding effect of a transfer suction box in the combination to achieve optimum transfer of the web W away from the wire 33 to the endless transfer belt 41.

Figure 3:
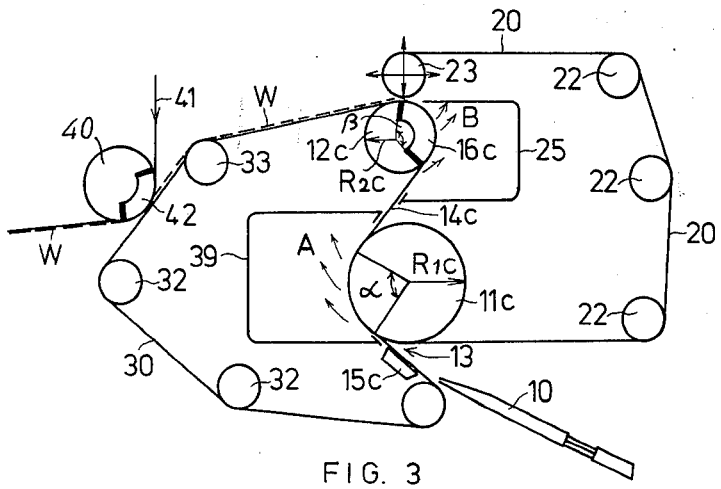
FIG. 3 is a schematic side elevation of an embodiment similar to that of FIG. 2 except that the forming rolls are respectively situated in different wire loops.

The embodiment of the invention which is illustrated in FIG. 3 is in general similar to that of FIG. 1. One of the primary differences resides in the fact that the upper forming roll means 12*c* of the embodiment of FIG. 3 has a suction zone 16*c*. The radius R2*c* of the upper forming roll means 12*c* of FIG. 3 is substantially smaller than the radius R1*c* of the lower forming roll means 11*c* of FIG. 3. This lower forming roll means 11*c* of course has a solid shell through which fluid cannot penetrate. Preferably the diameter of the lower forming roll means 11*c* is approximately twice the diameter of the upper forming roll means 12*c*.

In connection with the upper forming roll means 12*c*, although this roll means has a suction zone 16*c*, only a relatively small, comparatively minor vacuum is provided at this suction zone, so that the dewatering is for the most part in a direction away from the shell of the roll 12*c*, which is to say in the direction of the arrows B indicated in FIG. 3. Thus, in this case also the dewatering at the upper forming roll means takes place primarily in a direction opposite to that of the dewatering at the lower forming roll means 11*c*. The primary purpose of the suction zone 16*c* is not to achieve any dewatering action, but rather to insure that the web W will continue to travel with the wire 30 beyond the discharge end of the common path of travel of the wires.

The formers illustrated in FIGS. 2 and 3 are intended for the manufacture of papers which have a fairly low base weight. It is moreover to be noted in this connection that the lower forming roll means 11*b* and 11*c* of FIGS. 2 and 3, respectively, may either be smooth-surfaced rolls or may have recessed surfaces, most appropriately, in this latter connection, grooved surfaces as described below in connection with FIGS. 4 and 5.

FIGS. 4 and 5 respectively illustrate embodiments of advantageous coating or covering structures at the surface of any of the above forming roll means which have a solid shell and which may be provided with recessed surfaces. Thus, FIG. 4 illustrate fragmentarily and schematically how a suitably profiled strip 60*a* is wound about the shell of the forming roll, while FIG. 5 illustrates how a corresponding strip 60*b* is wound about the shell, the profiles of these strips being somewhat different from each other although they achieve similar objectives. It will be seen that each of the wound strips 60*a* and 60*b* has on one side a longitudinally extending bulge 62 and on the opposite side a longitudinally extending groove 63 receiving the bulge 62, so that in this way the convolutions of the wound strip are securely connected with the roll. The structures shown in FIGS. 4 and 5 contribute favorably to the symmetry of the dewatering action.

It will be seen that with both of the embodiments of FIGS. 4 and 5, the groove has an innermost region 64*a* and 64*b* which in cross section is wider than a narrow-neck portion 65*a* and 65*b* of the groove. Furthermore, outwardly beyond the narrow neck portions 65*a* and 65*b*, the grooves flare outwardly to have the tapering portions 66*a* and 66*b*. As a result of the narrow neck portions 65*a* and 65*b*, the flow of water inwardly toward the wider portions 64*a* and 64*b* and outwardly from the latter is retarded. This construction reduces the possibility of marking the web undesirably and also delays and stabilizes the dewatering action.

With the embodiments of FIGS. 4 and 5, the surface structure of the rolls 11A and 11B is also highly favorable when the stock applied into the space between the wires 20 and 30 contains air which is carried along by the wires 20 and 30. The open surface structure provided by way of the tapered or flaring groove portions 66*a* and 66*b* pacifies the dewatering and web-formation process. In addition, water that has entered into the innermost wide groove portions 64*a* and 64*b* of the rolls 11A and 11B in the forming zone cannot easily be flung back outwardly from these innermost groove portions by centrifugal force because of the narrow neck portions 65*a* and 65*b* which serve to throttle this outwardly directed flow. Therefore, at the stage of the web forming process where the forming wires 20 and 30 leave the surface of the shell of a forming roll means having the structure of FIG. 4 or FIG. 5, there will be no immediate splashing of the water back into the web W. The throttling which is brought about by this groove construction has the result that the water quantity per unit of time flung back from the grooves is reduced and is distributed over a larger area than in the case where "open" grooves are utilized starting from the point where the wires 20 and 30 depart from the surface of either one or both of the forming roll means. It is in this case possible to interpose at this location a splash guard which prevents the return of the water into the web W.

As has been indicated above, a particularly favorable forming roll means of the invention is in the form of a rubber-clad roll. Such a forming roll means 100 is schematically shown in a fragmentary sectional manner in FIG. 6. Thus the forming roll means 100, which may be utilized either as the lower forming roll means or the upper forming roll means, or which may be utilized in each of these forming roll means, includes a shell 102 which is covered by a rubber layer 104 of suitable thickness.

In an experimental machine which was constructed in accordance with the present invention, a blind-drilled forming roll means was utilized. In this forming roll means, 95% of the total escaping quantity of water was removed at the lower forming roll means. This particular lower forming roll means had a dewatering sector lapped by the endless wire loops through an angle of 100°. The machine speed was 900 m/min. and the paper that was manufactured was 45 g/m$^2$, this paper being suitable for newsprint. Of course when the machine speed is increased, for example, to 1500 m/min., the dewatering capacity of a single lower forming roll means is inadequate, and in this event an efficiently operating upper forming roll means is required with the dewatering continuing at this upper forming roll means.

As is clear from the above example, the main part of the dewatering takes place at the lower forming roll means which is adjacent the headbox. When the paper machine speed is 900 m/min., then the dry matter content of the web subsequent to the initial forming roll means may be as high as 10%. This dry matter content is sufficient to enable the web to be transferred with the aid of a pick-up roll 40 to the press section. When the machine speed increases so as to be relatively high, on the order, for example, of 1500 m/min., then it is evident that there will not be an equally high dry matter content with only a single forming roll means. In this event it is essential to use a second forming roll means which operates efficiently.

In the conditions encountered with the above example, the thickness of the pulp stock jet discharging from the headbox slice is on the order of 8–9 mm. Inasmuch as the consistency of the stock is only about 0.5%, it follows that at the first forming roll means there is a water layer of a thickness of 8–9 mm., this water layer partially penetrating the surface structure of the forming roll means and partially being flung away from the roll surface through the wire.

It was in this case then possible to establish by measurements that about 60% of the suspension water escaped immediately outwardly from the roll while 40% penetrated the surface structure from which the water was only removed at a later stage. Thus even in this case where a single forming roll means is utilized there is a substantially symmetrical dewatering in opposite directions. Inasmuch as the proportion of the holes in the forming roll means is on the order of 50% of the total roll surface area, it is possible to calculate that the water penetrating into the surface structure penetrates into the holes of the forming roll shell to a depth of 7–8 mm. during the initial stage of the dewatering process.

When the web W has a comparatively high dry matter content at the first forming roll means, the dewatering which takes place subsequent to this point is considerably difficult to achieve. The diameter of the second or upper forming roll means is therefore chosen so as to be considerably smaller than that of the lower forming roll means, so that the pressure resulting from the tension of the wires 20, 30 on the web impacted between them is considerably greater at the upper smaller forming roll means than on the larger forming roll means, and of course the centrifugal force at the upper roll means in this case also is greater than at the lower forming roll means. As has already been pointed out, it is advantageous with a view to the operation of the former as well as with a view to minimizing the initial cost that the diameter of the upper forming roll means is only on the order of 30–70% of the diameter of the lower forming roll means.

The invention is of course in no way to be confined to the particular embodiments shown in the drawings and described above. Various details may of course vary within the scope of the inventive concept defined by the claims which follow below.

What is claimed is:

1. In a paper machine, a pair of endless wire loops respectively having elongated portions which travel together upwardly along a common path where said wire loops form a twin-wire former, said common path having a lower receiving end for receiving pulp stock from which a web is to be formed and an upper discharge end from which a web issues from said twin-wire former while being transported by one of said endless wire loops beyond said discharge end of said common path, lower forming roll means around which said endless wire loops are lapped with said lower forming roll means determining the lower receiving end of said common path and an initial portion of said common path along which the wire loops travel together, upper forming roll means around which said endless wire loops also are lapped with said upper forming roll means determining the discharge end of said common path and a final portion of said common path, said lower and upper forming roll means cooperating with said endless wire loops for providing at said lower and upper forming roll means dewatering which at least in part occurs in opposite directions at said lower and upper forming roll means, respectively, and said lower forming roll means having a solid shell through which fluid cannot penetrate and said lower forming roll means cooperating with said endless wire loops for providing at said lower forming roll means a dewatering which takes place at least to a substantial extent in a direction outwardly away from said lower forming roll means, said upper forming roll means being situated substantially in alignment with and above said lower forming roll means and also having a solid shell through which fluid cannot penetrate, said common path curving first in one direction about said lower forming roll means, then being substantially straight and tangential to both of said forming roll means, and then curving in an opposite direction around said upper forming roll means, so that said common path is of a substantially S-shaped configuration.

2. The combination of claim 1 and wherein a suction means is situated within the wire loop which transports the web beyond the discharge end of said common path at a location adjacent said upper forming roll means.

3. The combination of claim 1 and wherein both of said forming roll means respectively have substantially equal radii.

4. The combination of claim 1 and wherein the angular lapping of said lower roll means by said wire loops at the initial portion of said common path is substantially less than the angular lapping of said upper roll means by said wire loops at the final portion of said common path, for contributing toward symmetry of dewatering.

5. The combination of claim 4 and wherein the part of said common path occupied by said initial and final portions thereof is substantially greater than the intermediate straight part of said common path extending between said lower and upper forming roll means.

6. The combination of claim 1 and wherein at least one of said forming roll means has a smooth exterior surface.

7. The combination of claim 6 and wherein a doctor blade cooperates with said smooth surface for cleaning the latter.

8. The combination of claim 1 and wherein said lower forming roll means has a diameter substantially greater than the diameter of said upper forming roll means.

9. The combination of claim 8 and wherein said lower forming roll means has a diameter which is approximately twice as great as the diameter of said upper forming roll means.

10. The combination of claim 1 and wherein a breast roll means is situated in advance of said receiving end of said common path within one of said wire loops for guiding the latter to travel from said breast roll means to said receiving end of said common path, and forming board means situated within said one wire loop between said breast roll means and lower forming roll means and supporting said one wire loop as it travels from said breast roll means to said receiving end of said common path.

11. The combination of claim 1 and wherein a guide roll means is situated adjacent said discharge end of said common path within the wire loop which does not transport the web beyond said discharge end of said common path for guiding the latter wire loop, and adjusting means operatively connected to said guide roll means for adjusting the latter with respect to said upper forming roll means.

12. The combination of claim 1 and wherein a blower means is situated within the wire loop which does not convey the web beyond the discharge end of said common path adjacent to said discharge end for blowing compressed air through the latter wire loop for contributing to the conveying of the web beyond said discharge end of said common path on the other of said wire loops.

13. The combination of claim 1 and wherein at least one of said forming roll means has an outer covering formed by a strip wound onto said one forming roll means and having a profile which provides said one forming roll means with an exterior grooved construction.

14. The combination of claim 13 and wherein said strip has a profile providing the grooved construction with a grooved cross section having an innermost groove portion wider than an adjacent relatively narrow neck groove portion which retards travel of water into and out of said innermost groove portion.

15. The combination of claim 1 and wherein said lower and upper forming roll means and said endless wire loops having a plurality of relationships including the relationship between the radii of said lower and upper forming roll means, the relationship between the angles of said upper and lower roll means which are lapped by said endless wire loops, the relationship between the tension in the wire loops, and the relationship between the densities of the mesh of the endless wire loops, and said relationships contributing toward alternating substantially one-sided dewatering at said lower and upper forming roll means, respectively.

16. The combination of claim 1 and wherein at least one of said forming roll means is a rubber-clad roll.

17. The combination of claim 1 and wherein a return roll means is situated within the wire loop which transports the web beyond the discharge end of said common path at a location distant from said discharge end and toward which the web is transported, said return roll means guiding the latter wire loop for return toward the receiving end of said common path, a transfer felt loop situated next to the wire loop which transports the web beyond the discharge end of said common path, said transfer felt loop being situated in the region of said return roll means, and suction means cooperating with said transfer felt loop at the region where the latter is situated next to the latter endless wire loop for transferring the web from the latter wire loop to said transfer felt loop.

18. The combination of claim 17 and wherein said return roll means includes a suction zone at the region of said return roll means lapped by the wire loop which transports the web beyond said discharge end of said common path.

19. The combination of claim 17 and wherein said return roll means includes a blowing zone for blowing through said wire loop which transports the web beyond said discharge end of said common path, for contributing to transfer of the web to said transfer felt loop.

20. In a paper machine, a pair of endless wire loops respectively having elongated portions which travel together upwardly along a common path where said wire loops form a twin-wire former, said common path having a lower receiving end for receiving pulp stock from which a web is to be formed and an upper discharge end from which a web issues from said twin-wire former while being transported by one of said endless wire loops beyond said discharge end of said common path, lower forming roll means around which said endless wire loops are lapped with said lower forming roll means determining the lower receiving end of said common path and an initial portion of said common path along which the wire loops travel together, upper forming roll means around which said endless wire loops also are lapped with said upper forming roll means determining the discharge end of said common path and a final portion of said common path, said lower and upper forming roll means cooperating with said endless wire loops for providing at said lower and upper forming roll means dewatering which at least in part occurs in opposite directions at said lower and upper forming roll means, respectively, and at least said lower forming roll means having a solid shell through which fluid cannot penetrate and said lower forming roll means cooperating with said endless wire loops for providing at said lower forming roll means a dewatering which takes place at least to a substantial extent in a direction outwardly away from said lower forming roll means, at least one of said forming roll means having an outer covering formed by a strip wound onto said one forming roll means and having a profile which provides said one forming roll means with an exterior grooved construction, said strip having a profile providing the grooved construction with a grooved cross section having an innermost groove portion wider than an adjacent relatively narrow neck groove portion which retards travel of water into and out of said innermost groove portion.

* * * * *

UNITED STATES PATENT AND TRADEMARK OFFICE

CERTIFICATE OF CORRECTION

PATENT NO. : 4,113,556

DATED : September 12, 1978

INVENTOR(S) : Matti Kankaanpaa

It is certified that error appears in the above–identified patent and that said Letters Patent are hereby corrected as shown below:

(73) Assignee: Valmet Oy, Helsinki Finland

Signed and Sealed this

*Tenth* Day of *April 1979*

[SEAL]

*Attest:*

RUTH C. MASON
*Attesting Officer*

DONALD W. BANNER
*Commissioner of Patents and Trademarks*